United States Patent [19]

de Konig et al.

[11] 3,949,496

[45] Apr. 13, 1976

[54] WAVE COMPENSATING SYSTEM FOR SUCTION DREDGERS

[76] Inventors: Jan de Konig, 20, Soetendaal, Amsterdam; Romke van der Veen, 21, Prof. Dr. Hesselaan, Jutphaas; Tjako Aaldrik Wolters, 53, Kastanjelaan, Vianen, all of Netherlands

[22] Filed: Sept. 23, 1974

[21] Appl. No.: 508,621

Related U.S. Application Data

[63] Continuation of Ser. No. 327,307, Jan. 29, 1973, abandoned.

[30] Foreign Application Priority Data

Jan. 28, 1972 Netherlands ..... 7201215

[52] U.S. Cl. ..... 37/58; 37/72; 175/5; 188/314; 254/172; 254/175.7; 267/125

[51] Int. Cl.[2] ..... E02F 3/88

[58] Field of Search ..... 37/72, 58; 254/172, 173, 254/175.7, 185 R, 187 R; 267/125, 126; 188/314, 315; 175/7, 27, 5

[56] References Cited

UNITED STATES PATENTS

| | | | |
|---|---|---|---|
| 3,512,281 | 5/1970 | Hadjidakis | 37/72 X |
| 3,579,872 | 5/1971 | Jantzen | 37/72 X |
| 3,596,070 | 7/1971 | McCool et al. | 254/173 R X |
| 3,606,854 | 9/1971 | Van Lunteren | 254/172 X |
| 3,653,635 | 4/1972 | Bates, Jr. et al. | 254/172 |
| 3,681,862 | 8/1972 | De Koning et al. | 37/72 X |
| 3,734,564 | 5/1973 | McKay et al. | 37/69 X |
| 3,739,503 | 6/1973 | Barker et al. | 37/72 X |

FOREIGN PATENTS OR APPLICATIONS

| | | | |
|---|---|---|---|
| 851,333 | 10/1960 | United Kingdom | 37/72 |
| 627,307 | 8/1949 | United Kingdom | 254/175.7 |

*Primary Examiner*—Clifford D. Crowder
*Attorney, Agent, or Firm*—John P. Snyder

[57] ABSTRACT

A suction dredger, comprising a vessel and a suspension conveying conduit provided with a pump and having a nozzle suspended by means of at least one cable of a lifting device on the vessel is improved for preventing breaking of the cable or damage of other dredger parts. To this aim the lifting device comprises a cable length variator delivering cable and each time hauling essentially all delivered cable in work condition with a high cable tension being lower than the inadmissible cable tension, but being higher than a predetermined low cable tension, in order to prevent an inadmissible cable tension during a downward ground reaction upon the nozzle.

5 Claims, 10 Drawing Figures

WAVE COMPENSATING SYSTEM FOR SUCTION DREDGERS

CROSS REFERENCE TO RELATED APPLICATION

Figure 1:
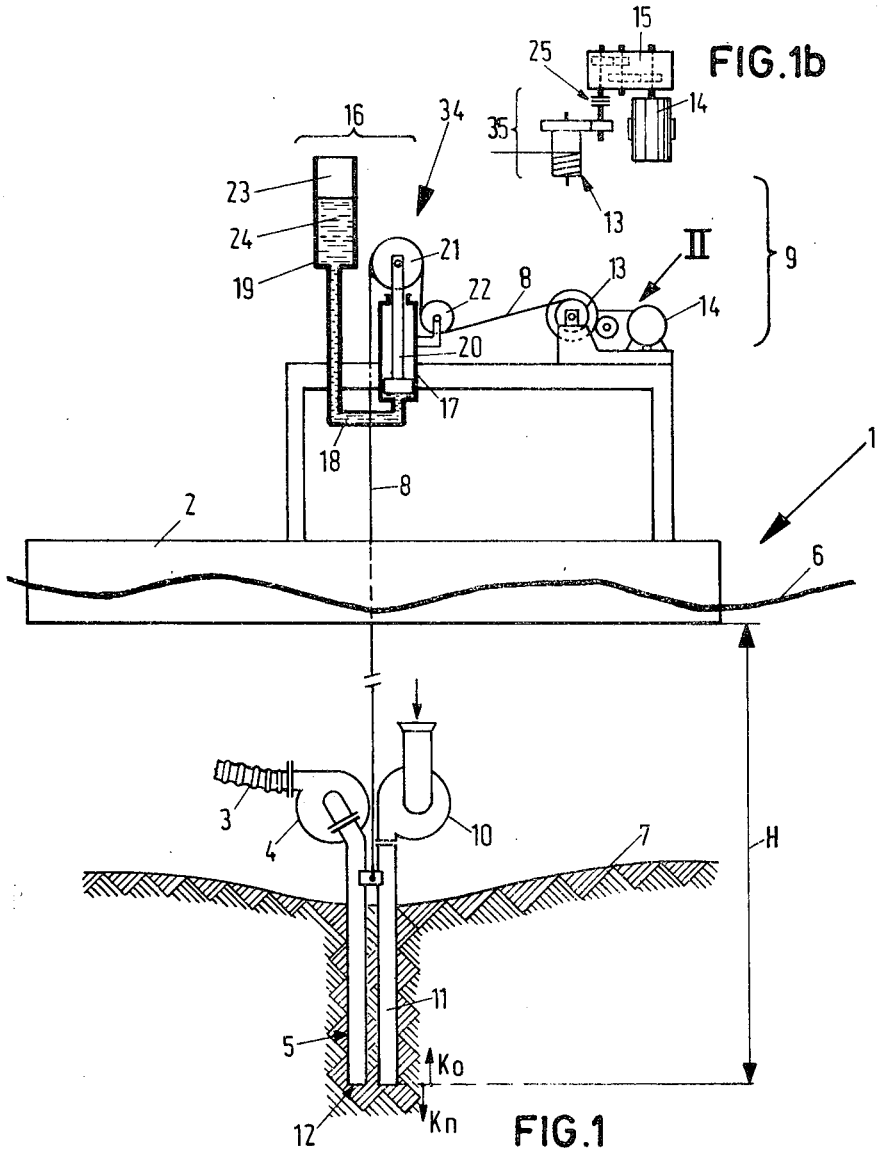

This application is a continuation of application Ser. No. 327,307, filed Jan. 29, 1973, and now abandoned.

The invention relates to a suction dredger, comprising a vessel and a suspension conveying conduit provided with a pump and having a nozzle suspended by means of at least one cable of a lifting device on the vessel, said lifting device mainly consisting of a cable store provided with control means for hauling and veering cable in order to adjust the depth of the nozzle with respect to the vessel, and consisting of a cable length variator which in work condition with a low cable tension each time when an upward ground reaction upon the nozzle arises hauls cable for preventing the cable from hanging slackly and which each time afterwards delivers hauled in cable.

Such a suction dredger is known.

This known suction dredger is with a large sea level movement not suitable for sucking up sand from the ground with a nozzle which is deeply inserted into the ground, because in case the nozzle sticks in the ground with an upward movement of the vessel the ground exerts a downward ground reaction upon the nozzle, owing to which the cable may break or another part of the suction dredger may be damaged.

The invention provides a suction dredger improved in this respect in that the cable length variator delivers cable in work condition with a high cable tension being lower than the inadmissible cable tension, but being higher than a predetermined low cable tension in order to prevent an inadmissible cable tension during a downward ground reaction upon the nozzle.

In a known suction dredger wherein the conduit comprises at least one second lifting point being suspended on the vessel by means of at least one second cable of a second lifting device, said lifting device comprising a cable store which is provided with control means for hauling and veering the second cable in order to adjust the depth of the lifting point with respect to the vessel and a cable tension guard hauling cable when decreasing below a low adjusted cable tension and delivering hauled cable, the second cable of the second lifting point is kept tightly by means of the cable tension guard, but the second lifting point cannot be positioned with this cable tension guard.

The invention, however, improves the suction dredger according to the invention for positioning the second lifting point, which is specially important for adjusting the pump which is possibly mounted in the conduit near said lifting point, on the right depth, in that the lifting device comprises a cable tension reduction device delivering cable when exceeding a high adjusted cable tension and hauling delivered cable, said low and high cable tension being lower and higher respectively than the nominal cable tension prevailing when the lifting point is at its adjusted depth.

The invention will be elucidated in the following description with reference to a drawing.

In the drawing schematically represent:

FIGS. 1, 2, 3 and 4 each a side view of a suction dredger according to the invention being each time further developed.

Figure 1A:
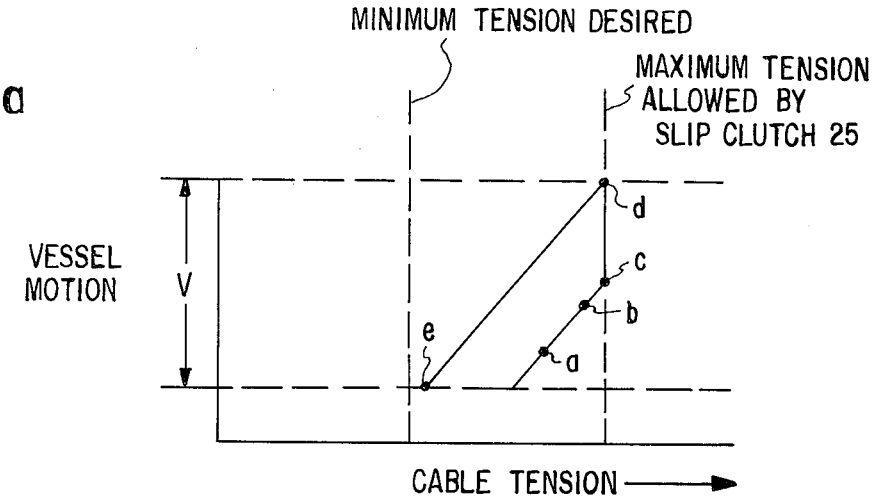
Figure 2B:
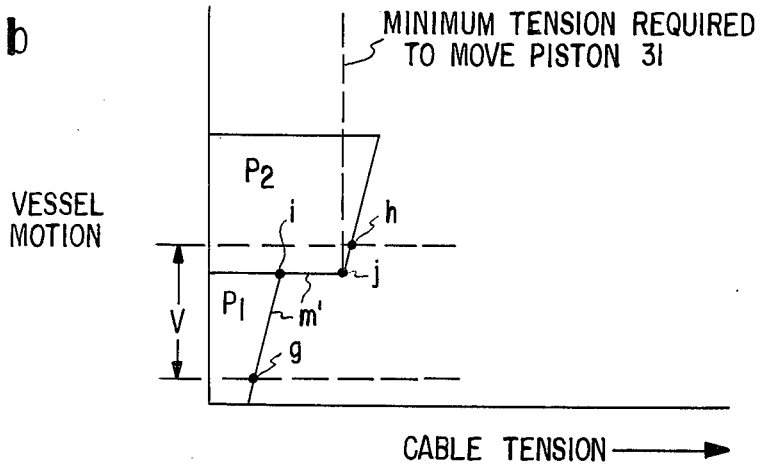
Figure 2C:
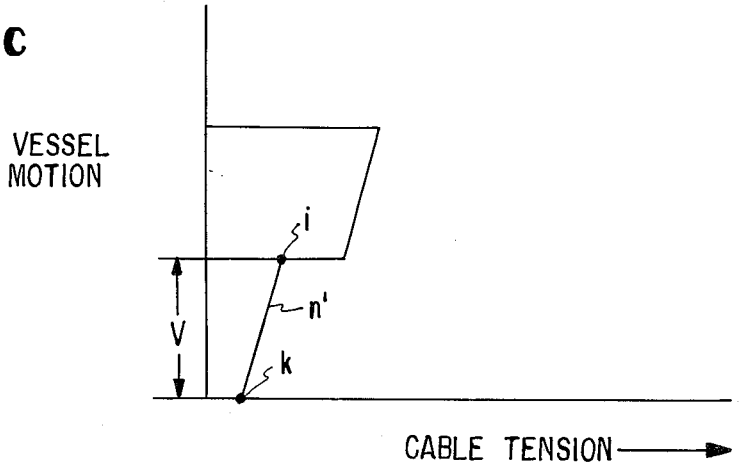
Figure 2:
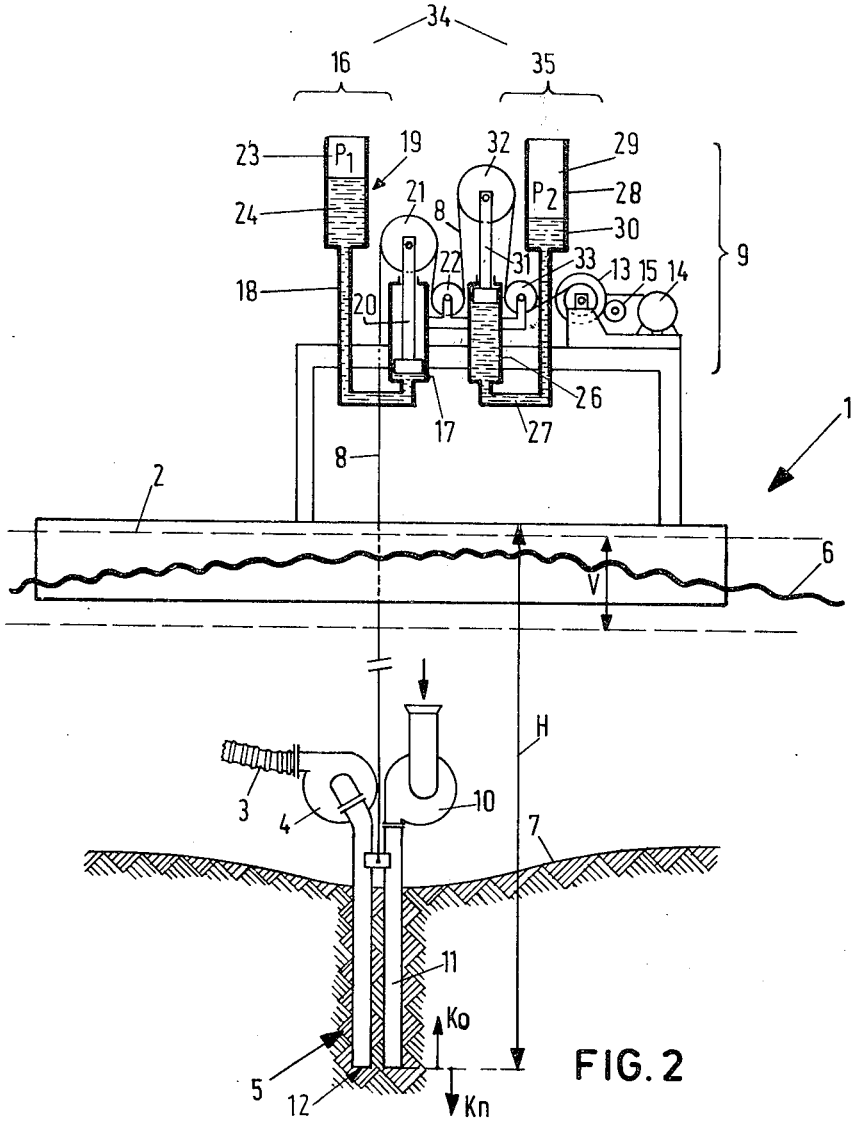
Figure 2A:
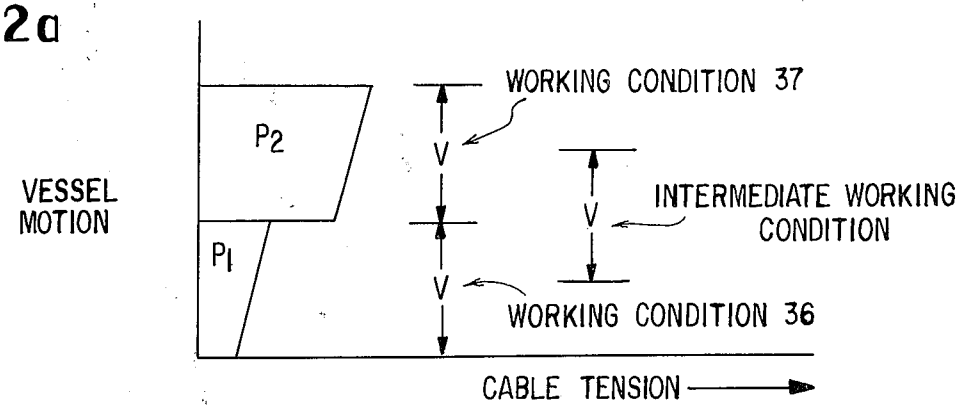
Figure 3A:
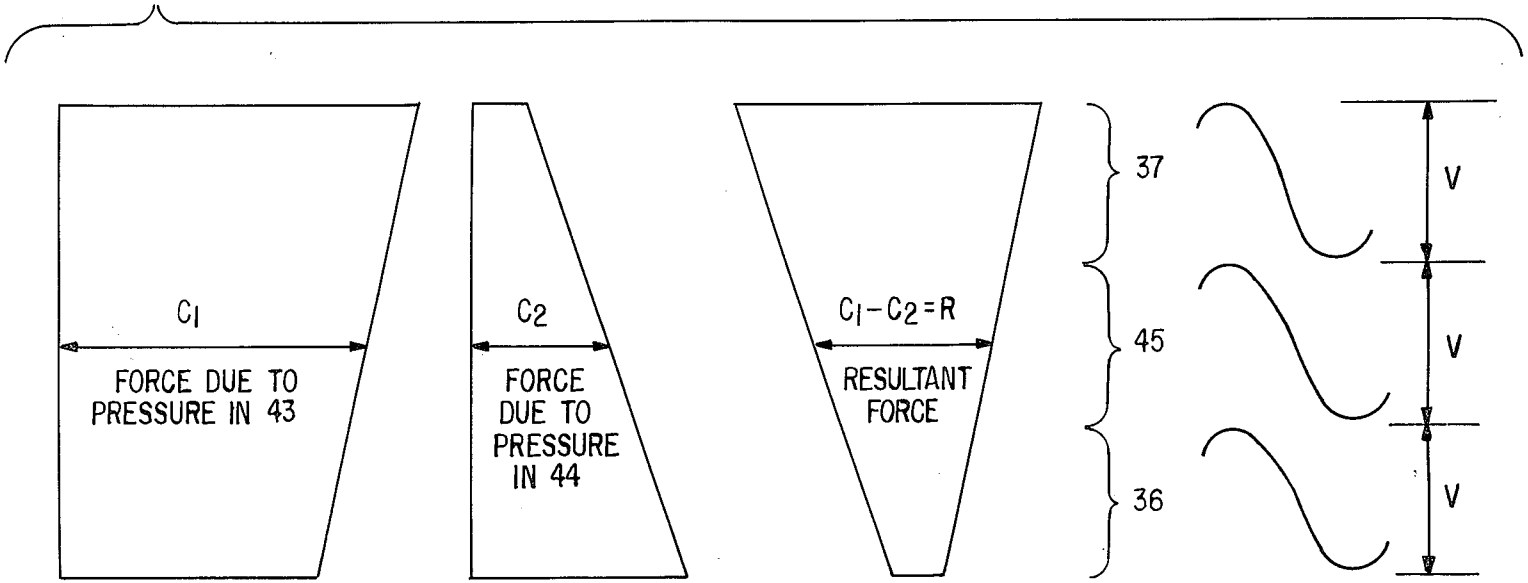
Figure 3:
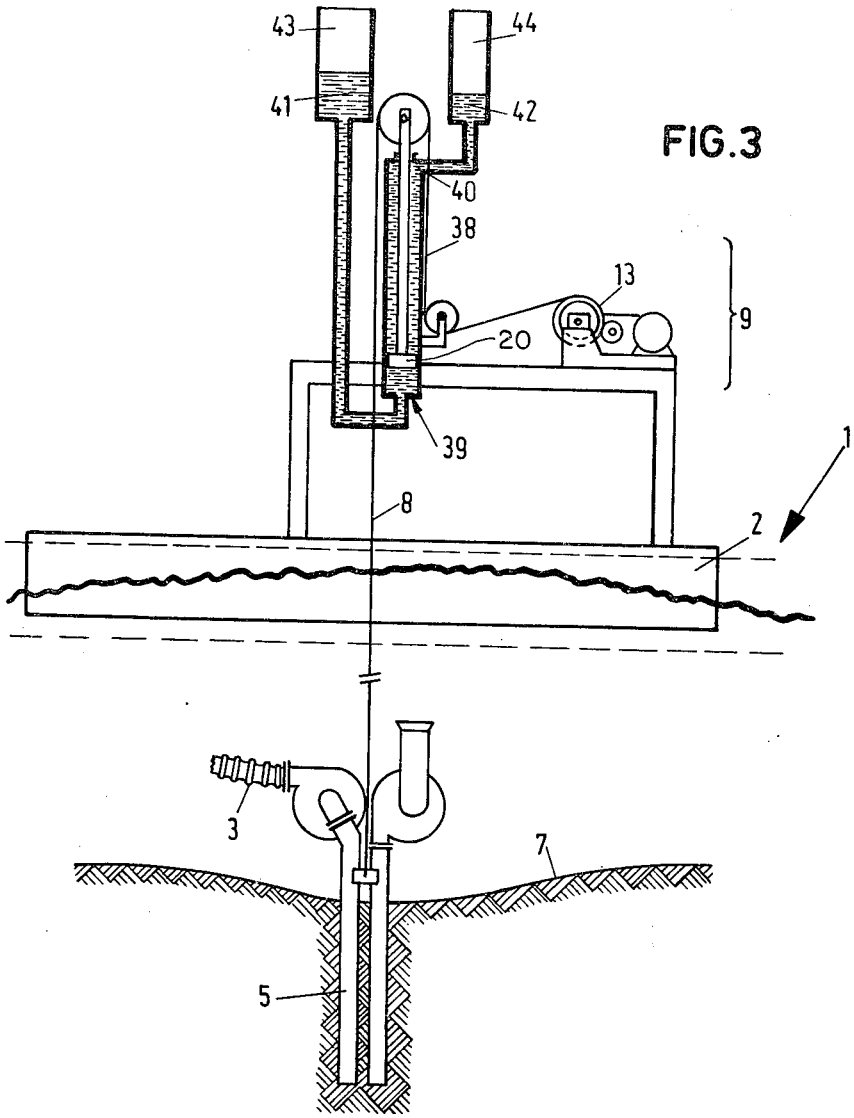

FIGS. 2*a* and 3*a* each a diagram of forces of the cable length variator of the suction dredger of FIGS. 2 and 3 respectively, and FIGS. 1*a*, 2*b* and 2*c* are diagrams of cable tension versus vessel motion for the embodiments of FIGS. 1 and 2, respectively, and FIG. 1*b* a plan view of detail II of FIG. 1.

The suction dredger 1 of FIG. 1 comprises a vessel 2 floating on water 6 and a flexible conduit 3 conveying a suspension of sand and water to a place of destination, a pump 4 being mounted in said conduit 3 and a nozzle 5 of said conduit 3 being suspended on the vessel 2 by means of a cable 8 of a lifting device 9 carried by the vessel 2, said nozzle 5 being deeply inserted into the sand 7 to be sucked up and lying under water 6. Water is supplied by means of a water pump 10 carried by the nozzle 5 via a conduit 11 into the bottom near the inlet 12 of the nozzle 5, resulting in a suspension of sand 7 and water 6 entering the conduit 3 through the inlet 12 of the nozzle 5. The lifting device 9 mainly consists of a cable store constituted by a winch drum 13 provided with control means constituted by a motor 14 and provided with a drive gear 15 controlled for hauling and veering cable 8, in order to adjust the depth H of the nozzle 5 with respect to the vessel 2.

In FIG. 1, reaction forces $K_o$ and $K_n$ are shown and which arise by virtue of the fact that the nozzle is inserted deep in the bottom. The reaction force $K_o$ represents reaction of the ground which at least partially supports the weight of the dredging assembly, whereas the reaction force $K_n$ represents the ground reaction which resists lifting of the dredging assembly and thus is additive to the weight thereof. These forces come into play when wave action on the vessel 2 causes it to rise and fall, consequently to vary the tension in the cable 8. Obviously, if the cable 8 were attached rigidly to the vessel, the rise and fall of the vessel would cause the assembly 5 correspondingly to rise and fall, the cable tension fluctuating between a maximum during rising motion dictated by the weight of the assembly plus the reaction force $K_n$ and some minimum value dependent upon the value of the reaction force $K_o$. That is, if $K_o$ is less than the weight of the dredging assembly by an amount sufficient to allow the assembly 5 to sink at least as fast as the fall of the vessel, some residual minimum cable tension will result. However, the reaction force $K_o$ normally will be large enough to prevent this condition such that at some time during fall of the vessel 2, the cable 8 will go completely slack. Obviously, it would be desirable to maintain a minimum tension in the cable 8 even at the lowest point of the expected rise and fall of the vessel 2 and also to limit the tension in the cable to some maximum value even at the highest point of the rise of the vessel 2. For this reason, the tension control means 34, 35 is provided in FIG. 1. The tension control means of this embodiment includes the wave motion compensating means 34 and the tension-modifying or tension-limiting means 35. Briefly stated, the means 34 of FIG. 1 operates automatically to take in the cable 8 as the vessel falls so as to maintain a minimum tension in the cable even at the lowest point of vessel fall, which tension is not less than an inadmissable minimum tension. The means 34 operates continuously to exert an upward force on the cable 8 so that at the lowest point of vessel motion at least the aforesaid minimum tension is maintained.

The embodiment of FIG. 1 is adapted to accommodate for and up to a maximum vertical motion of the vessel 2, as illustrated in FIG. 1*a*. When the vessel motion is at a maximum V, the cable tension will vary back and forth along the line *n* due to the action of the means 34 alone. To illustrate the automatic cable tension limiting feature, assume that initially the wave motion imparts only a small vertical motion to the vessel and that the amount of cable paid out causes the means 34 to operate with a stroke which varies the cable tension along the line *m* between the points *a* and *b* in FIG. 1*a*, the amount of cable which has been payed out from the drum 13 being effective to determine the minimum value of cable tension corresponding to point *a* (i.e. if more cable is payed off the drum, the line *m* will be shifted to the left in FIG. 1*a* thus lowering the minimum cable tension at *a* and the maximum cable tension at *b*). If the vessel now experiences the maximum expected motion V, the point *c* will be reached during rising motion of the vessel at which time the means 35 comes into play because the means 34 is at the bottom of its stroke, the means 35 limiting the cable tension to the maximum admissable value. Thus, between point *c* and the high point *d* the maximum admissable cable tension is not exceeded and as the vessel falls, the cable tension retreats along the line *n* ultimately to reach the minimum value at point *e* which is at or in the region of the minimum admissable cable tension. The stroke S of the means 34 thus is capable of accommodating for the vessel maximum motion V while keeping the cable tension between the minimum and maximum admissable values. The means 34 consists of a cable length variator 34 comprising a hydropneumatic cable tension guard 16 which is built up of a hydraulic cylinder 17 communicating via a conduit 18 with a pressure tank 19 wherein air 23 having a low pressure $P_1$ is locked up above liquid 24, said pressure $P_1$ being of a value when the piston is at the top of its stroke during the expected travel S nearly to correspond with the required minimum cable tension for preventing the cable 8 from getting slack when the vessel is in the trough of a wave. The piston rod 20 of the hydraulic cylinder 17 carries a pulley 21 for guiding the cable 8 which is diverted by pulley 22. With an upward ground reaction $K_o$ upon the nozzle 5 during a downward movement of the vessel 2 as a result of sea level movement the distance between the vessel 2 and the nozzle 5 becomes temporarily less than the adjusted depth H and the cable tension guard 16 hauls cable 8 owing to a decrease below the adjusted cable tension (at point a, for example in FIG. 1a), in that the piston rod 20 with the pulley 21 moves upwardly then with a maximum travel S belonging to the maximum variation V of the sea level movement to be expected. In the next upward movement of the vessel 2 the cable tension increases with respect to the minimum cable tension, resulting in hauling cable delivered owing to a downward movement of the piston rod 20.

According to the invention the cable length variator 34 comprises yet another cable tension reduction device 35 consisting of the winch drum 13 and a slip coupling 25 which is mounted between the drive gear 15 and the winch drum 13. When the sand 7 exerts upon the nozzle 5 a downward ground reaction $K_n$, e.g. owing to sticking of the nozzle 5 in the sand 7, while the vessel 2 moves upwards and the cable tension guard 16 has already delivered all hauled cable, the cable tension exceeds the maximum value adjusted in the slip coupling 25 and arising in work condition 37 of the cable length variator 34 with high cable tension resulting in that the winch drum 13 delivers cable for preventing an inadmissible cable tension.

The suction dredger 1 of FIG. 2 is identical to the suction dredger 1 of FIG. 1 with the understanding that the cable tension reduction device 35 in hydropneumatic. This cable tension reduction device 35 consists of a hydraulic cylinder 26 communicating via a conduit 27 with a pressure tank 23, wherein air 29 having a high pressure $P_2$ is locked up above liquid 30, said pressure $P_2$ belonging to a work condition 37 having a high cable tension which is lower than the inadmissible cable tension, but which is higher than the low cable tension. The piston rod 31 carries a pulley 32 for guiding the cable 8 which is diverted by rope pully 22. The cable 8 is guided via pulley 33 to the winch drum 13. With a downward ground reaction $K_n$ the piston rod 31 moves downwardly against the high pressure $P_2$ and delivers thus cable 8, which is each time hauled afterwards with an upward movement of the vessel 2. The repeatedly coming into operation of the cable tension reduction device 35 gives an indication, that more cable has to be unwinded from the winch barrel 13 to stop the movements of this cable tension reduction device 35 acting against a high pressure $P_2$. If the cable 8 is veered, the piston rod 20 of the cable tension guard 16 acting against a low pressure $P_1$ moves up and down.

To illustrate the operation of FIG. 2, reference is had to FIGS. 2*a*, 2*b* and 2*c*. Assume initially that the vessel travels up and down the distance V with the amount of cable paid out from the drum 13 being such that both the wave compensation means 19 and the means 35 come into play. Under these conditions, the cable tension will vary back and forth along the line *m'* of FIG. 2*b* between the points *g* and *h*. Thus, as the vessel rises, the point i will be reached at which time the means 19 will have reached the bottom of its stroke at which time the cable tension is a function of the maximum value of pressure P1. Since the minimum value of the pressure P2 at which the means 35 comes into play is greater than the maximum value of P1, the cable tension will increase instantaneously along the line segment *i-j* and the means 35 then comes into play to limit the cable tension between the points *j* and *h*. Thus, the means 35 comes into play every time the vessel reaches the upper part of its motion V. If cable is payed out, the effect is to shift the cable tension variation line downwardly in FIG. 2*b* as indicated at *n'* in FIG. 2*c* so that both the minimum cable tension and the maximum cable tension at the point *k* and *i* respectively are determined solely by the means 34 for the vessel motion V. Similarly, if cable were to be taken up, the means 19 would always be bottomed during vessel motion and cable tension would be varied only by the means 35. FIG. 2*a* shows the three conditions described for the same vessel motion V in each case. Thus, a working condition 36 is one in which the vessel motion is not great enough to exceed the stroke of the means 19 and the amount of cable paid out is sufficient to operate only the means 19; the working condition 37 is one in which the vessel motion is not sufficient to exceed the stroke of the means 35 and the amount of cable taken in is sufficient to maintain the means 19 bottomed so that only the means 35 operates; and an intermediate working condition is one in which the amount of cable taken in is such as to cause both of the means 19 and 35 to operate. Obviously, when the vessel motion becomes large one can operate only in the intermediate working condition.

The suction dredger 1 of FIG. 3 is identical to the suction dredger 1 of FIG. 2 with the understanding that instead of two hydropneumatic cylinders 17 and 26 for the cable tension guard 16 in the low work condition and for the cable tension reduction device 35 in the high work condition only one hydropneumatic cylinder 38 is provided having a travel T which is considerably greater than the variations V of the cable length as a result of sea level movement (see FIG. 3a). The lower end 39 and the upper end 40 of the cylinder 38 communicate with pressure tanks 41 and 42 wherein air 43 and 44 respectively is locked up.

FIG. 3a represents the components $C_1$ and $C_2$ working by the oil upon the piston as well as the resultant R in the various piston positions. The cable length variator 34 operates in the work condition 36 with a low pressure as cable tension guard and in the work condition 37 as cable tension reduction device.

In that the cable length variator of FIG. 3 also operates in the work condition 45 lying between the work condition 36 and 37, it is possible to restrict the movements of the nozzle 5 with respect to the ground 7, so that the nozzle 5 can be kept nearly in its adjusted suction position in spite of sea level movements.

To explain the operation of FIG. 3, reference is had to FIG. 3*a*. As the vessel rises, the piston 20 moves downwardly to increase the pressure in chamber 43 while the pressure in chamber 44 decreases, the effects of the pressures in these two chambers being indicated at C1 and C2 respectively and since they are opposing, the resultant R is of the form shown. The cable tension is of course determined by the resultant R. If enough cable is payed out from the drum 13 so that at the low point of the travel V the piston 20 is at or near the top of its stroke, the resultant R will be at a minimum value and, for the motion V, the cable tension will be operating in the low tension working condition 36 because at the crest of motion V the piston will not reach anywhere near the bottom of its stroke. If a great deal of cable is then hauled in on the drum 13, the piston 20 will operate such that at the crest of the motion V, the piston will be at or near the bottom of its stroke and, consequently for the motion V, the piston will not be anywhere near the top of its stroke when the trough of the motion V is reached. In between these two extremes, the amount of cable payed out from the drum 13 is such that the piston operates neither anywhere near the top nor near the bottom of its stroke as the trough and crest respectively of the motion V are reached. This work condition 45 is thus an intermediate one.

Figure 4:
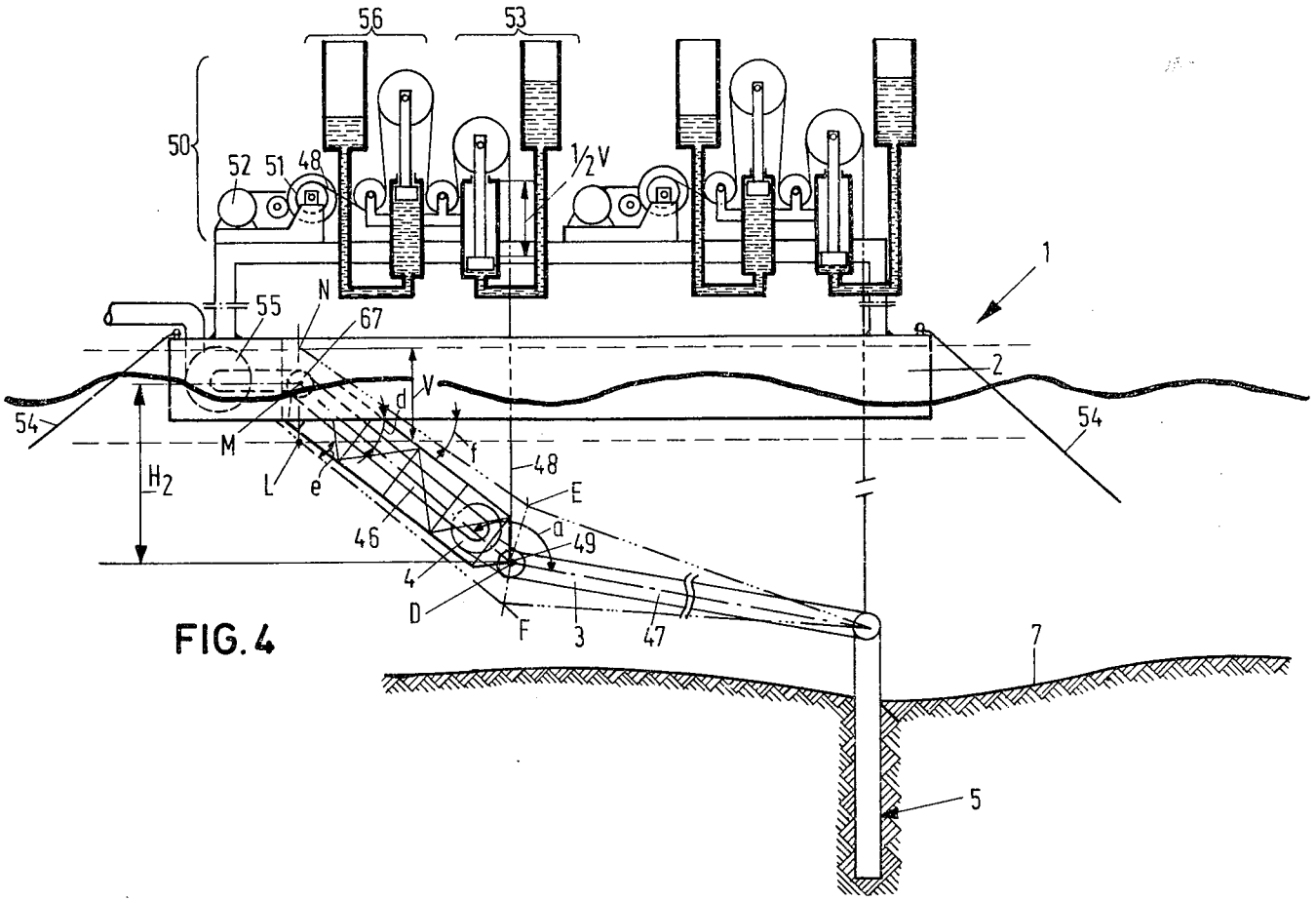

The suction dredger 1 of FIG. 4 differs from the suction dredger of FIG. 2, in that the conduit 3 consists of a rigid tube part 46 swingably suspended on the vessel 2 and of a tube part 47 swingably connected with the tube part 46 and in its turn swingably connected with the nozzle 5. These swingable connections are universally hinging. A second lifting point 49 at the lower end of tube part 46 in the neighbourhood of a pump 4 mounted in the conduit 3, is suspended on the vessel 2 by means of a second cable 48 of a second lifting device 50. Moreover another pump 55 is provided on board of the vessel 2. The lifting device 50 comprises a cable store constituted by a winch drum 51 provided with control means 52 for hauling and veering cable 48 in order to adjust the depth of the lifting point 49 with respect to the vessel 2 to such extent that the pump 4 is adjusted on the desired depth and that the angle *a* is smaller than a predetermined value in order to avoid, that the tube parts 46 and 47 come nearly in line with each other, as a result of which large pressure forces would occur during sea level movements.

If the vessel 2 is anchored by means of anchoring wires 54 the hinge 67 moves during sea level movements round a position M between N and L and the lifting point 49 moves in the vicinity of the adjusted point D between E and F. The cable reactions $P_D$, $P_E$ and $P_F$ belonging to the points D, E and F are dependent on the relative angles *d*, *e* and *f*.

For nearly maintaining the adjusted depth $H_2$ of the lifting point 49 a hydropneumatic cable tension guard 53 is provided, which hauls cable 48 during a downward movement of the vessel 2 when decreasing unto below a low adjusted cable tension $P_X$ which is smaller than the nominal cable tension $P_D$ and which is greater than the cable reaction $P_F$. During upward movement of the vessel 2 hauled cable 48 is delivered again and the cable tension reduction device 56 delivers then further cable 48, if the cable tension exceeds the adjusted value $P_Y$ which is greater than the nominal cable tension $P_D$. With downward movement of the vessel 2 delivered cable 48 is hauled again. This second lifting device 50 results in that the second lifting point 49 swings about the adjusted depth $H_2$ with a half travel up and down, said travel being smaller than the maximum half variation V to be expected.

In the arrangement of FIG. 4, since the lifting point 49 is not embedded in the bottom as is the case for the nozzle 5, it will move vertically dependent upon variations in tension in the cable 48. At some nominal tension value $P_D$, the cable 48 just supports the weight acting at the lifting point 49 and it is the purpose of the means 53, 56 to so limit the maximum and minimum values $P_E$ and $P_F$ of cable 48 tension in response to a vertical excursion V of the vessel 2 such that the lifting point 49 experiences an excursion approximately equal to (V/2). Since the means 53 acting alone can be so constructed that it will produce the requisite maximum and minimum cable tensions which affect the excursion (V/2) for a particular weight of lifting point 49, the amount of cable payed out from drum 51 is adjusted to cause only the means 53 to operate. Before this adjustment of the cable 48 is effected, the means 56 operates to prevent too much tension in the cable 48 and, moreover, gives a visual indication when the cable 48 has not been payed out enough.

In all of the embodiments described, it will be apparent that a piston-cylinder wave compensation means operates in conjunction with tension limiting means always to maintain cable tension between prescribed minimum and maximum limits in the presence of maximum vessel excursion V, much beyond which the sea is too heavy to compensate. In fact, most of the time the vessel excursions will be less than V, in which case there is a wide range of cable tension adjustment available simply by hauling in or paying out cable from the winch and which allows the variation in cable tension to be adjusted best to suit the needs of the moment. For example, it is obvious that the maximum admissable cable tension will be some multiple of that necessary to raise or lower the entire dredging assembly, as for example in FIG. 2. Thus, with the assembly lowered and inserted in the soil, this maximum admissable cable tension will not be approached even remotely unless during rise of the vessel there is a tendency to overcome not only the weight of the dredger assembly but also the downward ground reaction thereagainst, and even then there must be a tendency to "snatch" the nozzle 5 upwardly. Clearly, one would not normally contemplate operation at maximum tension, due to cresting of the vessel at a value anywhere near this limit because the usual case would be to support the nozzle 5 through cable tension so that very little if any vertical motion thereof would result except as is specifically controlled by "creeping" the winch 13 to pay out or take in cable. The second means 53, 56 of FIG. 4 is of course the exception to this rule because the function there is to limit movement of the point 49, but the above does apply to the first or principal means of FIG. 4 which operates identically with that of FIG. 2.

It should be noted that the wave compensation means in each case is a piston-cylinder means which acts upwardly on the cable, i.e. the piston-cylinder means 17, 20 of FIG. 1; whereas in each case the tension limiting means acts to control or limit maximum cable tension caused by vessel rise. In FIG. 1, the tension limiting means is in the form of the slip clutch 25; in FIG. 2 it is in the form of a second piston-cylinder means 35; and in FIG. 3 it is in the form of the accumulator 44 which acts continuously to oppose the pressure in the accumulator 43. An important advantage of the systems of FIGS. 2, 3 and 4 is that the tension limiting means thereof does not require paying out of cable in order to maintain the nozzle at its adjusted depth in the ground as held there by the reaction force $K_n$.

We claim:

1. A suction dredger comprising, in combination:

a buoyant hull and a suction dredging system associated therewith, said suction dredging system including a nozzle adapted to be inserted into the bottom below the hull, and flexible conduit means connected to said nozzle for conveying dredger spoil to a discharge region;

winch means on said hull for supporting said nozzle and including at least one cable connected to said nozzle and a motor to operate the winch means for hauling in and paying out said cable whereby to locate said nozzle at a desired depth below said hull;

a first piston/cylinder device one member of whose piston and cylinder members is connected with said cable to reciprocate as said hull rises and falls while said nozzle remains at said desired depth, a first fluid pressure accumulator chamber connected with said device and acting on said one member continuously to urge it in that direction required to haul in said cable whereby to maintain tension of at least a minimum value on said cable even when said hull falls to the lowermost point in the trough of a wave and to exert an increasing tension on the cable as said hull thereafter rises, the pressure in said first fluid pressure accumulator being such that when said one member approaches its end of stroke position responsive to rising of said hull, the tension on said cable is less than a predetermined maximum value; and a second piston/cylinder device one member of whose piston and cylinder members is connected with said cable to reciprocate as said hull rises and falls, a second fluid pressure accumulator chamber connected with said second device and acting on said one member thereof continuously to urge it in that direction required to haul in said cable, the pressure in said second fluid pressure accumulator being such that said second device is operable only in response to tension in said cable which exceeds that value prevailing when said one member of the first device reaches said end of stroke position, and the stroke of said one member of the second device being such that at its end of stroke position the tension on said cable is still less than said predetermined maximum value.

2. A suction dredger as defined in claim 1 including a nozzle-supporting ladder having a first section pivotally connected at one end to said nozzle and a second section pivotally connected to the other end of said first section, said cable being connected to said one end of the first section, a second cable connected to the two sections adjacent their pivotal interconnection, a second winch engaging said second cable, a third piston/cylinder device and a third fluid pressure accumulating chamber connected therewith and operating on said second cable in the same fashion as said first piston/cylinder device and first chamber operate on said first cable, and a fourth piston/cylinder device and a fourth fluid pressure accumulating chamber connected therewith and operating on said second cable in the same fashion as said second piston/cylinder device and second chamber operate on said first cable.

3. A suction dredger comprising in combination:

a buoyant hull and a suction dredging system associated therewith, said suction dredging system including a nozzle adapted to be inserted into the bottom below the hull, and flexible conduit means connected to said nozzle for conveying dredger spoil to a discharge region;

winch means on said hull for supporting said nozzle and including at least one cable connected to said nozzle and a motor to operate the winch means for hauling in and paying out said cable; and tension control means associated with said cable for maintaining tension in said cable greater than an inadmissible minimum tension when the hull falls in the trough of a wave and for maintaining tension in said cable less than an inadmissible maximum tension when the hull rises on the crest of a wave, said tension control means comprising:

compensating means engaged with said cable for paying out and taking in cable between said winch means and said nozzle as said hull respectively rises and falls due to wave action, said compensating means including at least one piston/cylinder device having relatively movable piston and cylinder members, a fluid pressure accumulator chamber connected with said device and means connected to one member of said device and engaged with said cable whereby said one member reciprocates between stroke end limits respectively as the hull rises and falls with pressure in said accumulator chamber continuously acting on said one member in that direction required to haul in cable; and tension-modifying means independent of said motor of the winch means for allowing said cable to be payed out in excess of that amount permitted by the effect of said compensating means alone.

4. A suction dredger as defined in claim 3 wherein said tension-modifying means comprises a second accumulator chamber connected to said piston/cylinder device continuously to act on said one member in that direction required to pay out cable.

5. A suction dredger as defined in claim 3 wherein said tension-modifying means comprises an overload release clutch for paying out cable from said winch means without requiring operation of said motor.

* * * * *

UNITED STATES PATENT OFFICE

CERTIFICATE OF CORRECTION

Patent No. 3,949,496 Dated April 13, 1976

Inventor(s) Jan de Koning et al.

It is certified that error appears in the above-identified patent and that said Letters Patent are hereby corrected as shown below:

On the Cover Sheet, under "United States Patent" "de Konig et al." should read -- de Koning et al. --.

In item "[76]" "Inventors: Jan de Konig, 20, Soetendaai" should read -- "Inventors: Jan de Koning, 20, Soetendaal --.

Signed and Sealed this

Twentieth Day of July 1976

[SEAL]

*Attest:*

RUTH C. MASON
*Attesting Officer*

C. MARSHALL DANN
*Commissioner of Patents and Trademarks*